United States Patent [191]

Smith et al.

[11] 4,197,548

[45] Apr. 8, 1980

[54] ANTENNA STABILIZATION SYSTEM

[75] Inventors: Dorsey T. Smith, Garland; William B. Stuhler, Plano, both of Tex.

[73] Assignee: B. E. Industries, Inc., Garland, Tex.

[21] Appl. No.: 691,287

[22] Filed: Jun. 1, 1976

[51] Int. Cl.[2] ..... H01Q 3/00

[52] U.S. Cl. ..... 343/765; 343/757

[58] Field of Search ..... 343/766, 765, 763, 757, 343/756, 761, 758

[56] References Cited

U.S. PATENT DOCUMENTS

| | | | |
|---|---|---|---|
| 2,475,746 | 7/1949 | Kenyon | 343/766 |
| 2,551,180 | 5/1951 | Starr et al. | 343/765 |
| 2,604,698 | 7/1952 | Ewing | 343/765 |
| 2,893,002 | 6/1959 | Ross | 343/765 |
| 2,907,031 | 9/1959 | Meredith | 343/756.5 |

*Primary Examiner*—Alfred E. Smith
*Assistant Examiner*—David K. Moore
*Attorney, Agent, or Firm*—Crisman & Moore

[57] ABSTRACT

An antenna mounting structure is supported and oriented by three linear hydraulic actuators responsive to linear position transducers of a passive stabilization system serving as a vertical reference for keeping an antenna precisely pointed at a geostatically satellite during motion disturbances. The antenna is assembled with each of the linear actuators connected thereto through a gimbaled mount which facilitates accommodation of the requisite angulation thereof necessitated by motion in adjacent actuators. Response in each actuator is derived through an independent linear servo loop directly communicating with a linear position transducer constructed in scaled replication of the respective antenna actuator geometrical configuration and assembled to an inertially stabilized platform. A proportional error signal is thereby generated in the linear position sensors which effectively comprises a mechanical analog computer adapted for integrating pitch, yaw, roll motions and directly converting them into the requisite triaxial linear command signals for the linear actuators. The triaxial control facilitates compensation of pitch, yaw, roll motions while maintaining a preselected polarization configuration.

20 Claims, 2 Drawing Figures

ANTENNA STABILIZATION SYSTEM

BACKGROUND OF THE INVENTION

The invention relates to an antenna stabilization system, and, more particularly, to an antenna support structure oriented by linear actuators responsive to linear position transducers of a passive stabilization system serving as a vertical reference and control network therefor.

It is generally the practice when utilizing communication antennas on land or water to mount the antenna wherein its radiation pattern remains essentially in a fixed reference frame. It is similarly common practice to incorporate gimbaled supporting structure to facilitate angulation and orientation thereof. This conventional practice of mounting has many applications such as satellite tracking for communication and navigational purposes. Frequently such applications also require antenna stabilization systems which compensate for certain movements such as pitch and roll motions of the supporting platform in order to maintain the preselected frame of reference of the antenna. Consequently, antenna support apparatus has been developed for compensating for such movement as it occurs and for detecting the relative magnitude thereof for integrating such information into compensational error signals which cause the antenna supporting structure to maintain the preselected frame of reference. Similarly, apparatus has been developed for generating the coordinate reference base for sensing relative motion. In particular, zero error reference frames have been developed for such systems wherein the reference frame is comprised of inertial coordinates from which compensation signals may be generated to maintain the preselected coordinate frame with zero deviation error. The methods and apparatus providing this reference system for antenna position control have recently found widespread application in offshore energy exploration operations.

The utilization of satellite communication terminals aboard offshore drilling and production platforms offers substantial operational and cost advantages to the oil and gas industry. Efficient utilization of such terminals, however, is largely dependent upon the ability to keep a relatively large antenna precisely pointed at a geostationary satellite during all types of motion disturbances. Such disturbances take the form of roll, pitch and yaw motions as experienced on semi-submersible platforms and, to a larger extent, on drilling ships. Because satellite system requirements often dictate beam stability better than 0.8°, other motion disturbances such as structural deflections due to wind, ice and wave action on both jack-up rigs and fixed production rigs are also primary considerations with regard to the antenna position.

Prior art apparatus for stabilizing antenna systems and other commercial and military hardware has included the aforementioned compensational error signal variety adapted for offshore applications. In an effort to maximize efficiency and response time, systems may also incorporate the pendulous properties of the antenna itself to assist in maintaining the preselected reference frame. One such system, incorporating both methods, is described and claimed in British Pat. No. 890,264, entitled "Rotatable Antenna Assembly", the complete specification of which was published on Feb. 28, 1962, having previously been filed in the U.S. on Feb. 2, 1959. The system set forth therein is characterized by dual axis rotation sensing means coupled to roll and pitch detecting gyroscopes and incorporated into a network of torquers adapted for first and second generation rotational actuation in response to the aforementioned sensor and gyroscopic outputs. In this manner the mass of the antenna itself may be utilized in compensating for undulations of the supporting structure while the reference plane error detected is ostensibly driven toward zero.

Certain other prior art apparatus has included strapped down level and rate sensors for detecting yaw, pitch and roll of an antenna mounted on a gimbaled plane. The signals from the sensors are integrated to actuate roll and pitch axis sensors adapted for negating error signals and maintaining the gimbal level in preselected inertial coordinates comprising the frame of reference. The actuators for such an apparatus are generally comprised of servo motors operating therefrom. The servo drive packages are conventionally mounted within the antenna pedestal base beneath the sensor package in order to orient the antenna and controlling sensors which are strapped to the same reference plane therewith.

The aforesaid apparatus has been shown to be effective in meeting the prior art demands of accuracy and cost effectiveness. However, the need for more reliable stabilization systems and more cost effectiveness therewith in the search for offshore energy reserves has fostered the development of improved antenna stabilization systems such as those exhibiting first generation error compensation and shorter response time. As disclosed above, it may be seen that many conventional prior art approaches incorporate error detection and compensation systems which include compensatory actuation for maintaining zero error detection in the sensor package and in the antenna structurally tied thereto. For example, the torquer units of the British patent above-referenced are utilized to correct rotational deviations in both the sensor package and actuation network. Such efforts, even when incorporating the pendulous effect of the antenna, involve relatively complex network feedbacks for driving the error signal to zero. Similarly, the strapped down sensor packages of related prior art approaches primarily drive the antenna and sensor platform toward a zero error reference. The necessity for complex feedback control is aggravated by the need of strictly linear actuation. Inherent component errors of such systems are similarly amplified in recycling feedback networks generating over compensation when roll and/or pitch amplitudes approach higher levels of the type convantionally encountered in high seas.

It would be an advantage therefore to overcome the problems of prior art apparatus by providing an improved stabilization system for antenna mounts, optical mounts and/or military artillery mounts incorporating true linear compensational actuation without deriving error signals from a zero error reference frame. The stabilization system of the present invention is especially adapted for true linear actuation in direct response to first generation error sensing. Moreover, error compensation actuation is confined to the apparatus supporting frame rather than including a sensor package because the only true reference plane is inertially stabilized and requires no error correction. Since all primary movement is detected relative to an inertially stabilized reference, all motion can be broken down into a combination of linear movements comprising the coordinate frame of both the antenna-actuator combination and reference plane-sensor combination. In this manner linear position transducers may be utilized where heretofore impracticable and direct antenna compensation signals generated in a control network functioning as an analog computer rather than a feedback network. Inherent component errors may thus be reduced and response time shortened to achieve accuracy and control heretofore unfeasible with compatible commercial cost levels.

SUMMARY OF THE INVENTION

The invention relates to a stabilization system for antennas and the like, which includes an inertially stabilized floating reference plane and linear position transducers which generate compensational position signals therefrom. More particularly, one aspect of the invention involves an antenna supporting pedestal including first and second frame sections adapted for the support and pivotal movement and positioning of the antenna. Linear actuator means are coupled between the frame sections for controlling the positional relationship therebetween and maintaining a predetermined antenna orientation therefrom. An inertially stabilized, floating reference from which linear position transducer means may sense relative movement therewith. Controlling means, responsive to the transducer means, are then incorporated to cause the linear actuator means to impart compensational movement to the first frame section relative to the section for maintaining the predetermined antenna postion therefrom.

Unlike prior art methods and apparatus, an error signal is not generated for the purpose of correcting the reference plane position and zeroing out the error indication. Instead, a compensation signal, which may also be referred to as an error signal, is generated from a linear position transducer and is fed to a linear actuator which directly responds thereto. In this manner the reference plane error is monitored rather than corrected and all compensational responses are first generation in type rather than being the product of an error feedback network integration.

In another aspect of the invention the linear actuator means coupling the first and second frame sections comprises a geometrical configuration substantially identical to the geometrical configuration comprised of the linear position transducer means coupling the stabilized reference plane and a fixed extension of the second frame section. A conventional hydraulic cylinder, or the like, may comprise a position control device of the linear actuator means for controlling the antenna position as related to a particular reference axis. The utilization of a linear position transducer which is systematically compatible, via appropriate servo amplifiers, with the hydraulic actuator, or the like, provides for the direct coupling of the two elements without an interface network and wherein all signals responded to are purely compensational rather than error feedback in type.

In yet another aspect of the invention, an array of linear actuators may be utilized for interconnecting the first and second frame sections of the antenna pedestal. An array of linear position transducers may be utilized for interconnecting a fixed extension of the second frame section and an inertially stabilized reference plane. In this manner the geometrical configuration of the linear position transducer array may be in reduced scale replication of the geometrical configuration of the actuator array. One advantageous ramification of such an assemblage includes the capacity to maintain the antenna orientation fixed relative to the stabilized reference plane without feedback error computations or integration.

In still another aspect of the invention, geometrically equivalent triaxial arrays of linear position transducers and linear actuators may be utilized for stabilizing the position of an antenna relative to an inertially stabilized reference plane. The triaxial configuration can be provided through a single support beam, suitably apertured for actuator mounting. By inputting signals from positioned transducers similarly assembled through a support beam, three axes control can be obtained for compensating yaw, pitch and roll of the supporting craft and maintaining antenna polarization. Such control is provided through a reference plane capable of generating sufficient inertial stability for interacting with linear position transducers. In this manner all antenna movements, generated by craft undulations or in response to linear actuators, are relative to said fixed reference plane.

BRIEF DESCRIPTION OF THE DRAWINGS

For a more complete understanding of the present invention and for further objects and advantages thereof, reference may now be had to the following description taken in conjunciton with the accompanying drawings, in which.

DETAILED DESCRIPTION

Figure 1:
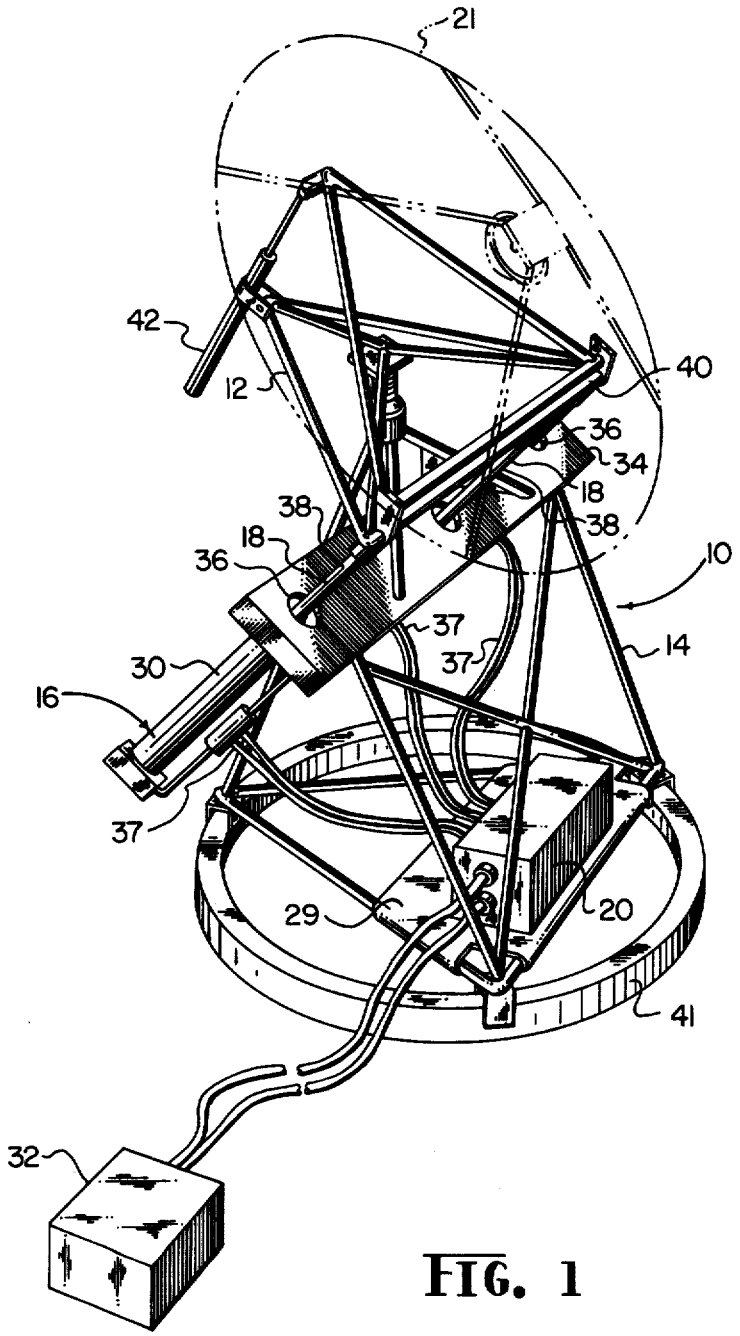
FIG. 1 is a perspective view of one embodiment of an antenna stabilization system constructed in accordance with the principles of the present invention and with an antenna disc shown in phantom for purposes of illustration.

Referring first to FIG. 1 there is shown a perspective view of one embodiment of a stabilization system constructed in accordance with the principles of the present invention and adapted for the stabilized support of apparatus such as antennas, optical equipment and military hardware. The system, as shown, includes a support pedestal 10 adapted specifically for an antenna and including upper and lower frame sections 12 and 14, respectively, which are pivotally mounted one to the other. A triaxial array of positional control actuators 18 are provided in an interconnecting configuration between the antenna frame sections 12 and 14. The triaxial motion imparted therefrom is compensatory to pitch, yaw and roll motion with a preselected polarization, or rotational position of frame section 12. Beneath the lower frame section 14, a control system 20 of relatively smaller size is provided for detecting movement of said frame section, such as pitch and roll, which would cause a positional deviation of an antenna 21 mounted thereabove and for causing the array 16 to respond with compensational actuation and relative repositioning of frame section 12 with regard to frame section 14. Within control system 20, a stabilized reference plane is provided for generating a stable, floating platform of predetermined inertial coordinates from which relative pitch-roll movement can be detected. The term "floating" is herein utilized to refer to the multi-axes angulation and rotation characteristic of the platform preferably provided through a gimbaled mount. In this manner, relative positional motions are sensed and directly inputed to the antenna support pedestal 10 wherein compensational movement of the upper frame seciton 12 is effected for maintaining the preselected orientation thereof. Unlike a variety of prior art methods and apparatus, the error signal generated via the reference frame is not driven to zero.

Figure 2:
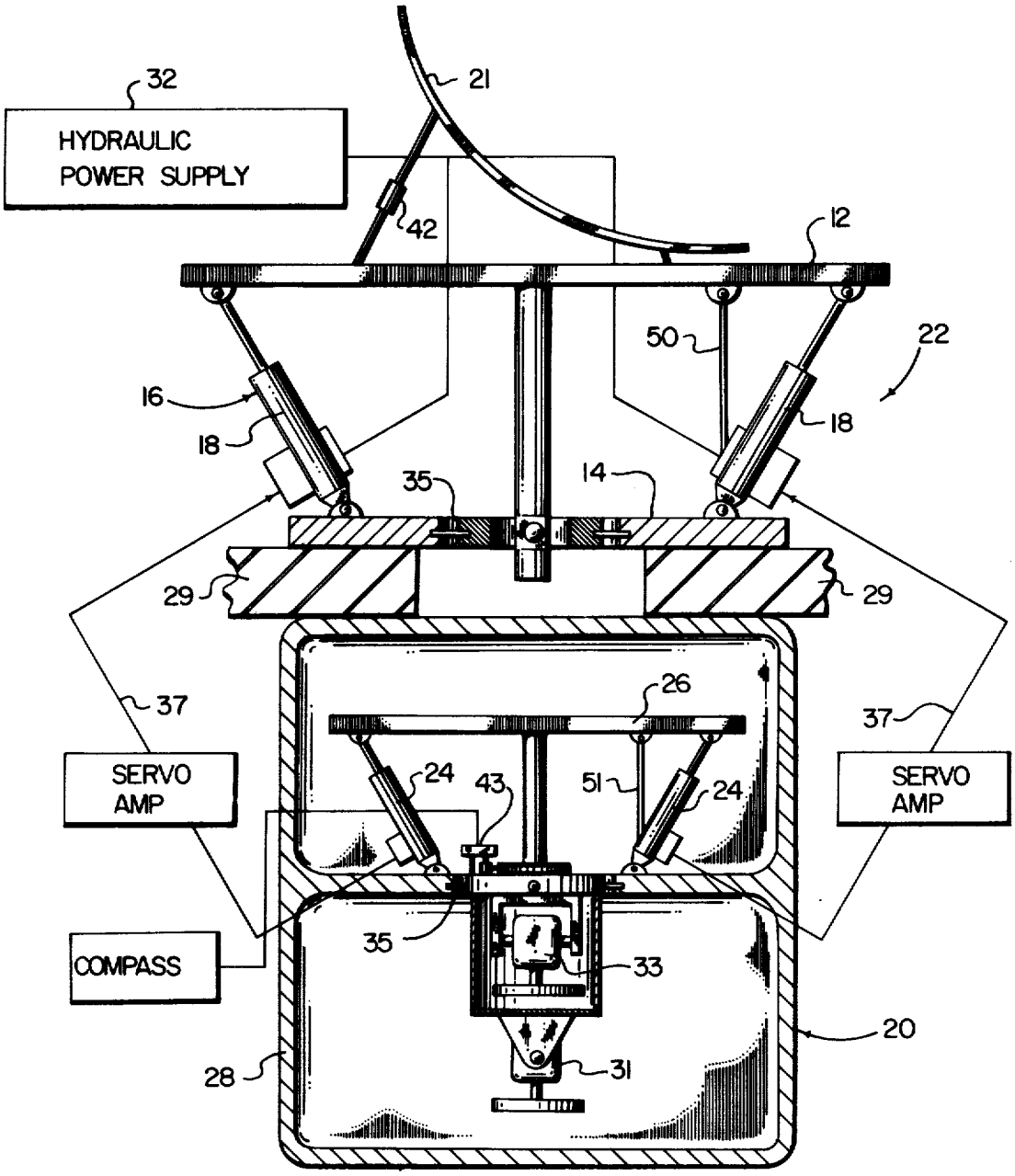
FIG. 2 is a diagrammatic illustration of an antenna stabilization system constructed in accordance with the principles of the present invention.

Referring now to FIG. 2 there is shown a diagrammatic illustration of an antenna stabilization system 22 constructed in accordance with the principles of the present invention and, illustrating a control network incorporating an array 16 comprising a pair of linear actuators 18. The system 22, as shown, includes a diagrammatic representation of the antenna pedestal 10 including simplified representations of upper and lower frame sections 12 and 14. The two actuators 18 are shown to interconnect the antenna frame sections in a geometrical configuration comprised of angle and length relationships between the corresponding elements of the assemblage. It may be seen that beneath the antenna pedestal 10, the control system 20 is representatively shown to include a structural assemblage geometrically identical to the aforementioned geometrical configuration of the actuator-antenna frame construction. As used herein the term "geometrically identical" means that all corresponding angles are the same and all corresponding length relationships are equivalent. In this manner the control 20 may be but one-twentieth (1/20) the size of the antenna pedestal 10.

The structural assemblage illustrated in FIG. 2 represents one embodiment of a control system 20 constructed in accordance with the principles of the present invention wherein linear position transducers 24 are incorporated to interconnect an inertially stabilized reference platform 26 with a fixed extension of frame section 14. The geometrical configuration of the linear position transducer array is preferably in replication of the actuator array with geometrically equivalent angle and proportional length characteristics. In this manner the transducer-reference platform assemblage facilitates the provision of direct compensational command signals from the control system 20 to the actuators 18, as discussed in more detail below.

Referring now to FIGS. 1 and 2 in combination, it may be seen that the antenna pedestal 10 is constructed for pivotal support of an antenna mounted thereon. Frame section 12 is thus pivotally mounted for multi-axes rotation about frame section 14. Similarly, reference platform 26 is pivotally mounted for multi-axes rotation about a reference frame section 28, rigidly secured to a structural extension 29 of antenna frame section 14. When reference plane 26 moves relative to frame section 28, transducers 24 signal actuators 18 that a proportionate linear movement is needed to maintain the preselected geometrical replication between the two assemblages. The transducers may include linear pots or synchros with linear-to-rotary motion converters. Actuators 18 are provided to respond accordingly for maintaining the frame section 12 in fixed relative positioning and orientation with reference platform 26. Suitable servo amplifiers are preferably utilized to input the actuators 18 as shown in FIG. 2. In this manner antenna stabilization is achieved without conventional feedback computation or zero error drive.

The control system 20 facilitates the above-described direct analog control of the antenna pedestal 10 by incorporating a plane of reference from which position transducers may be physically actuated. Reference plane 26 is thus constructed to exhibit sufficient inertial stability for conventional linear position transducer application unlike prior art approaches. In the particular embodiment shown and described herein, a combination gyro and pendulum weight stabilized platform is utilized. Such a combination is shown and described in U.S. patent application, Ser. No. 512,530, filed on Oct. 7, 1974 entitled "Combination Gyro and Pendulum Weight Passive Antenna Platform Stabilization System" and assigned to the assignee of the present invention and now U.S. Pat. No. 4,020,491. The structure set forth therein exhibiting two vertically aligned gyros has been shown to be satisfactory for producing a stabilized reference platform 26, although other types of inertially stabilized planes could similarly be utilized. In particular, the utilization of two gyros mounted side-by-side rather than vertically could be equally functional.

Referring now to the disclosure in said pending patent application, which is incorporated herein for all intent and purposes, it may be seen that two vertical axes flywheels, herein referred to as 31 and 33, respectively, which function as gyros, may be utilized to stabilize primary pitch and roll axes independently. The gyros 31 and 33 are essentially balanced about their pivotal axes with only a slight bias of the flywheel toward gravity. A controlled friction suspension system therein described is used for the gyro pivots to prevent the gravity bias from precessing the stable axis. The equivalent of a mechanical filter capable of storing a finite amount of energy, in one direction, is thus provided wherein the stored energy may be tapped when energy is applied in the opposite direction.

The gyro assembly above discussed and illustrated in FIG. 2 herein is preferably suspended with a gimbal structure 35 comprised of right angle pivot axes in substantially the same horizontal plane, with the center of gravity of the assembly on the vertical axis and below said gimbaled plane. The assembly is therein gravity-slaved and especially effective in applications wherein cyclic undulations of the supporting craft are prevalent, such as aboard ships where the sum of roll and pitch motions are generally approximately zero when referenced to gravity. The necessary inertial stability thereof for applications of position transducers and the relatively small magnitude of driving force necessary therewith, is particularly applicable to the present invention. Since all pitch and roll motions are broken down into linear movement as referenced from reference platform 26, the sum of the forces thrust upon the reference plane similarly approximate zero when referenced to gravity.

Still referring to FIG. 2, it may be seen that one end of each linear position transducer 24 is pivotally connected to the stabilized reference platform 26, and the other end is pivotally connected to a rigid extension of support beam 29 in the form of the frame, or housing 28, therein illustrated. Beam 29 is preferably a rigid structural element of antenna frame section 14 as shown in FIG. 1, although any suitably rigid, fixed extension of frame 14 would, to some degree, be satisfactory. It is theoretically conceivable to position beam 29 as a fixed extension of frame 14 at a point distant from the antenna pedestal 10 if the two are structurally interconnected through the supporting craft sub-structure. However, such positioning would reflect inherent deviational errors due to flexing of the structural frame therebetween.

The linear position transducers illustrated in FIGS. 1 and 2 are shown to be of the electrical variety and tied into a hydraulic actuation system. This preferred embodiment is shown only for purposes of illustration and other systems and combinations may be utilized. For example, motor driven lead screw actuators could be used instead of hydraulic cylinders. A hydraulic system of the type illustrated generally includes hydraulic cylinders 30 with pressure fluid lines 37, which as illustrated in FIG. 1, comprise the actuators 18. A conventional hydraulic power supply 32 is thus illustrated adjacent the control system 20 for interaction therewith in controlling and powering cylinders 30. Similarly, there is shown in FIG. 2 the diagrammatical representation of same as utilized for two cylinders 30. It should be apparent that any number of cylinders 30 could be controlled in this manner and that the representation of a three cylinder array in FIG. 1 and a two cylinder array in FIG. 2 are for purposes of illustration.

It should be observed that pitch, yaw, roll corrections can be accommodated with two actuators 18 as shown in FIG. 2. However, the capacity to rotate the antenna 21 for aforementioned polarization compensation can only be facilitated with three or more actuators 18 as illustrated in FIG. 1. In the event only two actuators 18 are utilized, a pivotal connection or leg 50, as shown in FIG. 2, would preferably be included, to stabilize the antenna frame 12. It is the fixed length connection 50 which causes polarization changes in the antenna 21 during roll, yaw and pitch movement of the actuators 18. It should be observed, also, that corresponding leg 51 would similarly be necessary in the controller 20 for the aforesaid geometrical replication as shown in FIG. 2.

The three actuator array of FIG. 1 illustrates one preferred embodiment of the present invention having the capacity for controlling antenna position and polarization under pitch, yaw, roll motions. Yaw input is preferably accommodated by the inclusion of a conventional azimuth drive train and/or adjustment on the controller 20 and antenna pedestal 10. As representatively illustrated in FIG. 2 an azimuth drive 43 imparts rotation to the gyros 31 and 33 and the platform 26 itself and receives its input directly from the ship's compass to correct for heading changes. Corresponding yaw compensation is provided in the antenna pedestal 10 between frames 12 and 14. Mounting base ring 14, as shown in FIG. 1, facilitates rotation of the pedestal 10 for azimuth set up.

Unlike numerous prior art structural configurations providing such control latitude, the structural embodiment of FIG. 1 exhibits a single pivotal connection between antenna frame sections 12 and 14. Moreover, all pitch, yaw, roll motions are broken down into linear movement which triaxially (pitch, roll, yaw polarization orientation) originates across a single support beam 34 having gimbaled mounting apertures 36 provided therein. The cylinders 30 are secured within the gimbaled mounts 36 with the actuation struts 38 of each cylinder extending upwardly therefrom into pivotal interconnection with the frame 12 along a single arm 40 thereof. All referenced motion of frame section 12 is thus imparted along arm 40. Independent elevational positioning of the frame section 12 is preferably provided through a manually adjustable linkage element 42, representatively shown in FIGS. 1 and 2.

The hydraulic control and actuation network illustrated herein may be of a variety of conventional designs providing amplified, proportionate actuation reaction to input signals of relatively small magnitude. With such a network the antenna pedestal 10 may be constructed to accommodate an antenna structure of virtually unlimited size while providing equivalent stabilization features. It should be noted, however, that for pitch and roll motions greater than 15° and recurring elevational corrections, alternate constructional embodiments of the actuator-antenna frame interconnection may be necessary. For example, by conventionally mounting each actuator 18 independent of other actuators, rather than across a single support beam, as representatively shown in FIG. 2, greater latitudes of orientation flexibility may be achieved. Variations in the actuator assembly geometry would require similar changes in the control system 20 if direct analog signal generation was desired. It should be noted however, that direct analog signal generation can be provided without pure replication between the actuator and transducer arrays. For example, non identical geometrical equivalents can provide predetermined proportionate responses directly compensated for in the output actuation-input signal ratio of the servo amps and/or the actuators 18.

It is believed that the operation and construction of the above-described invention will be apparent from the foregoing description. While the antenna stabilization system and the method of assembly thereof shown and described have been characterized as being preferred, it will be obvious that various changes and modifications may be made therein without departing from the spirit and scope of the invention as defined in the following claims.

What is claimed is:

1. An antenna stabilization system comprising:

an antenna supporting pedestal including first and second frame sections adapted for the rigid and stabilized orientation of same, said first frame section being adapted for the support and securement of an antenna mounted thereto, and said second frame section being adapted for the pivotal support of said first frame section and the provision of relative movement therebetween;

linear actuator means coupled to, and adapted for imparting relative pivotal movement between said first and second frame sections for controlling the positional relationship therebetween and maintaining a predetermined antenna orientation therefrom;

an inertially stabilized, floating reference plane adapted for positioning in fixed relative positioning with said supporting pedestal and from which relative movement of said second frame section can be detected;

linear position transducer means for interconnecting said stabilized reference plane and a fixed extension of said second frame section for sensing movement therebetween which would cause a positional deviation of said first frame section; and controlling means responsive to said transducer means for causing said linear actuator means to impart compensational movement to said first frame section relative to said second frame section in proportion to the positional deviation thereof for maintaining said predetermined antenna position therefrom.

2. An antenna stabilization system as set forth in claim 1 wherein said linear actuator means coupling said first and second frame sections comprises a geometrical configuration substantially identical to the geometrical configuration comprised of said linear position transducer means coupled between said stabilized reference plane and said extension of said second frame section.

3. An antenna stabilization system as set forth in claim 2 wherein said linear actuator means includes a plurality of linear actuators and wherein an equivalent number of linear position transducers are provided in a geometrical replication thereof.

4. An antenna stabilization system as set forth in claim 3 wherein two linear actuators are provided.

5. An antenna stabilization system as set forth in claim 3 wherein three linear actuators are provided.

6. An antenna stabilization system as set forth in claim 1 wherein said stabilized reference plane includes a combination gravity slaved and gyro stabilized platform.

7. An antenna stabilization system as set forth in claim 1 wherein said linear actuator means comprises a hydraulic system including hydraulic cylinders connecting said first and second frame sections.

8. An antenna mounting system as set forth in claim 1 wherein said fixed extension of said second frame section comprises an integral structural member of said antenna supporting pedestal.

9. An antenna mounting system as set forth in claim 1 wherein said linear actuator means includes two or more actuator cylinders, said second frame section indlues a cylinder mounting beam, and each of said cylinders is connected to said beam through a gimbaled mount which facilitates accommodation of the requisite angulation thereof necessitated by movement in adjacent actuators.

10. An antenna mounting system as set forth in claim 9 wherein three actuator cylinders are mounted in a generally coplanar gimbaled configuration through said beam for triaxially orienting said first frame section.

11. An antenna stabilization system comprising:

an antenna supporting pedestal including first and second frame sections adapted for the rigid support and stabilized orientation of an antenna mounted thereon;

an array of linear actuators interconnecting said first and second frame sections for controlling the positional relationship therebetween and maintaining a predetermined antenna orientation therefrom, said array of linear actuators forming a geometrical configuration facilitating multi-axis relative motion between said first and second frame sections;

an inertially stabilized, floating reference plane for positioning in fixed relative positioning with said supporting pedestal and from which relative movement of said second frame section can be detected;

an array of linear position transducers for interconnecting said stabilized reference plane and a fixed extension of said second frame section for sensing movement therebetween which would cause a positional deviation of said first frame section;

said array of linear position transducers comprising a geometrical replication of said array of linear actuators; and controlling means responsive to said linear position transducers for causing said linear actuators to impart compensational movement to said first frame section relative to said second frame section in proportion to the positional deviation thereof for maintaining said predetermined antenna position therefrom.

12. An antenna stabilization system as set forth in claim 11 wherein said stabilized reference plane includes a combination gravity slaved and gyro stabilized platform.

13. An antenna stabilization system as set forth in claim 11 wherein two linear actuators and two linear position transducers are provided in geometrical replication of one another.

14. An antenna stabilization system as set forth in claim 11 wherein three linear actuators and three linear position transducers are provided in geometrical replication of one another.

15. An antenna stabilization system as set forth in claim 11 wherein said linear actuator comprises part of a hydraulic system including hydraulic cylinders connecting said first and second frame sections.

16. An antenna stabilization system as set forth in claim 11 wherein a triaxial array of linear actuators are mounted across a support beam through gimbaled apertures provided therein.

17. An antenna stabilization system as set forth in claim 11 wherein a triaxial array of linear actuators are utilized in compensating for pitch, yaw and roll motions of said second frame section and in maintaining the polarization of an antenna mounted thereon.

18. An improved stabilization system of the type adapted for maintaining apparatus mounted thereon in a fixed positional and orientational configuration relative to a reference frame of inertial coordinates and having a supporting pedestal including first and second frame sections pivotally coupled one to the other with means for controlling the relative angular relationship therebetween, said improvement comprising:

linear actuator means coupled to, and adapted for imparting relative pivotal movement between, the first and second frame sections for controlling the positional relationship therebetween and maintaining the predetermined orientation thereof;

an inertially stabilized, floating reference plane adapted for positioning in fixed relative positioning with the supporting pedestal and from which relative movement of the second frame section can be detected;

linear position transducer means for interconnecting said stabilized reference plane and a fixed extension of said second frame section for sensing movement therebetween which would cause a positional deviation of the first frame section; and controlling means responsive to said transducer means for causing said linear actuator means to impart compensational movement to the first frame section relative to the second frame section in proportion to the positional deviation thereof for maintaining the predetermined position thereof.

19. An improved stabilization system as set forth in claim 18 wherein said stabilized reference plane includes a combination gravity slaved and gyro stabilized platform.

20. An improved stabilization system as set forth in claim 18 wherein a plurality of linear actuators and a plurality of linear position transducers are provided in geometrical replication of one another for compensating for pitch, roll and yaw motions imparted to the supporting pedestal.

* * * * *